US005496248A

United States Patent [19]

Batscher

[11] Patent Number: 5,496,248

[45] Date of Patent: Mar. 5, 1996

[54] PERSONAL EXERCISE DEVICE

[76] Inventor: Robert K. Batscher, 68 Seventh St., Bonita Springs, Fla. 33923-7415

[21] Appl. No.: 419,901

[22] Filed: Apr. 11, 1995

[51] Int. Cl.[6] ..... A63B 22/16

[52] U.S. Cl. ..... 482/146; 482/147

[58] Field of Search ..... D21/193; 482/146, 482/147, 79, 80

[56] References Cited

U.S. PATENT DOCUMENTS

| | | | |
|---|---|---|---|
| D. 276,062 | 10/1984 | Dennis | D21/193 |
| 2,256,001 | 9/1941 | Titus | 482/147 |
| 2,803,461 | 8/1957 | Coplin . | |
| 2,950,120 | 8/1960 | Stewart . | |
| 3,188,087 | 6/1965 | Larson . | |
| 3,361,427 | 1/1968 | Paves . | |
| 3,967,820 | 7/1976 | Harper . | |
| 4,505,477 | 3/1985 | Wilkinson | 482/146 |
| 5,330,399 | 7/1994 | Fan . | |

FOREIGN PATENT DOCUMENTS

| | | | |
|---|---|---|---|
| 3620706 | 12/1987 | Germany | 482/146 |
| 4105313 | 8/1992 | Germany | 482/146 |

*Primary Examiner*—Jerome Donnelly
*Attorney, Agent, or Firm*—Merrill N. Johnson

[57] ABSTRACT

The Roc-A-Way™ personal exercise device is designed for use by a single person to improve his or her balance and sense of well being. It consists of a solid elongated member having at each of its ends a horizontal upwardly facing flat rectangular foot platform. The two spaced apart foot platforms are connected by an elongated downwardly curved center portion of the device whose downwardly facing lower surface touches the floor in a horizontal plane substantially lower than the plane of the two foot platforms. A smoothly rounded pivot point on the lower surface of the device is located near each end of the device directly beneath one of the upwardly facing foot platforms.

6 Claims, 2 Drawing Sheets

PERSONAL EXERCISE DEVICE

FIELD OF THE INVENTION

The invention lies in the field of personal exercise devices and more particularly relates to a device which permits the performance of unique body movements.

BACKGROUND OF THE INVENTION

A number of exercise devices have been proposed in which the exerciser stands on the elongated device with his or her feet apart resting upon two spaced apart foot platforms separated by the center portion of the device which sits on a floor lying in a horizontal plane lower than the foot platforms on which the exerciser is standing. The lower surface of the center portion of the device is curved to enable the exerciser to rock from side to side or to tilt forth and back and thereby exercise his leg and back muscles and at the same time improve his balance. See, for example, U.S. Pat. Nos. 2,950,120; 3,188,087; 3,361,427 and 3,967,820. However, the commercial success of devices made according to the foregoing patents all of which have now expired is not known.

SUMMARY OF THE INVENTION

Briefly put, my invention generally follows the form of the devices illustrated in the foregoing patents. However, by incorporating a combination of features not found or suggested in the foregoing patents the exerciser is able to perform unique body movements which contribute to the amusement and physical condition of the exerciser and at the same time increasing the exerciser's sense of balance and sense of accomplishment.

The first unique feature is a pair of smoothly rounded pivot points located near the ends of a convexly curved lower surface of the device and directly beneath the pair of upwardly facing foot platforms.

The second feature is that the lower surface of the center portion of the device is smoothly and convexly curved as to both its elongated length and its width.

The third feature is the inclusion of a pair of brake points at each end of the device which enable the exerciser to promptly stop further movement of the device by having three points of the device resting on the floor at the same time to provide a stable platform while the exerciser steps onto or off the device.

BRIEF DESCRIPTION OF THE DRAWINGS

The accompanying drawings are intended to illustrate and explain the invention which is set forth in the text of this application.

DETAILED DESCRIPTION OF THE PREFERRED EMBODIMENT

Figure 1:
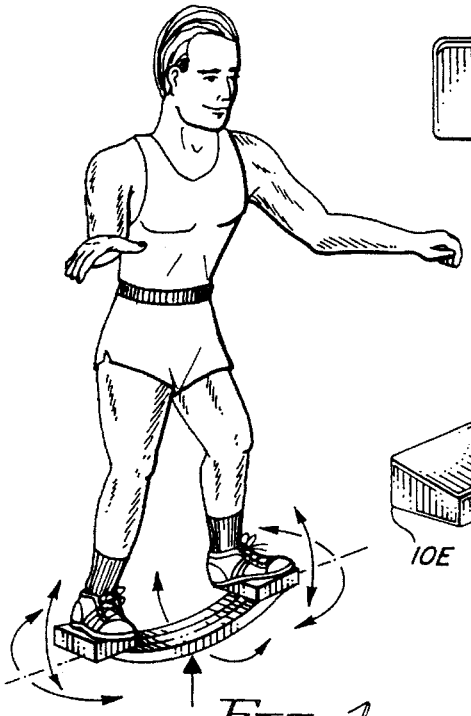
FIG. 1 illustrates an exerciser using the invention to rock from side to side and to tilt forth and back similarly to the movements possible with prior exercise devices.
Figure 8:
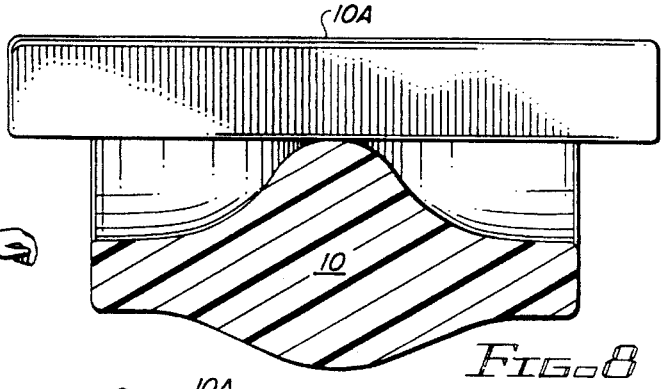
FIG. 8 is a cross-sectional view of the device taken along line 8—8 of FIG. 3.
Figure 3:
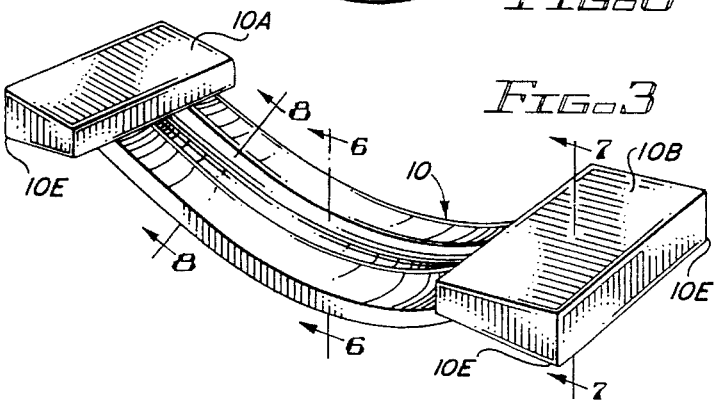
FIG. 3 is a perspective view taken from above of the exercise device shown in FIGS. 1 and 2.
Figure 2:
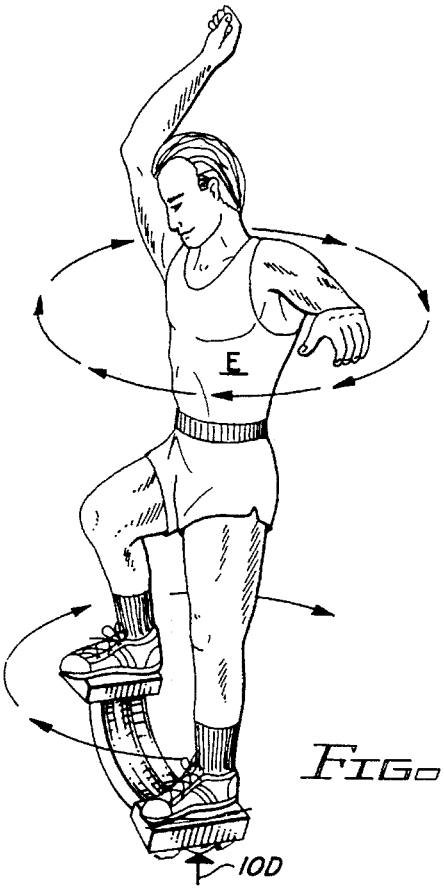
FIG. 2 illustrates an exerciser twirling around and around with the exercise device resting,solely on one of its two rounded pivot points.
Figure 6:
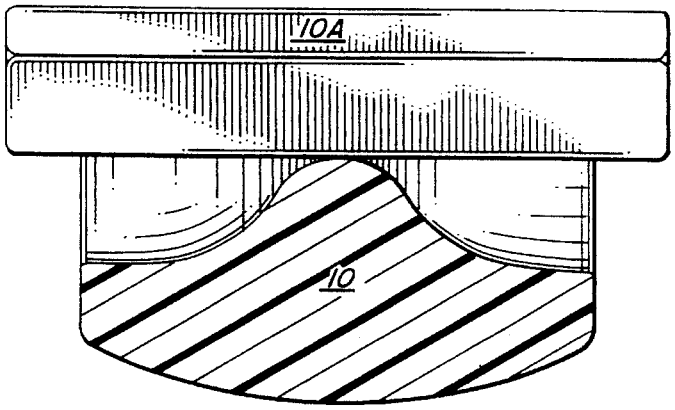
FIG. 6 is a cross-sectional view taken at the midpoint of the device along line 6—6 of FIG. 3.
Figure 7:
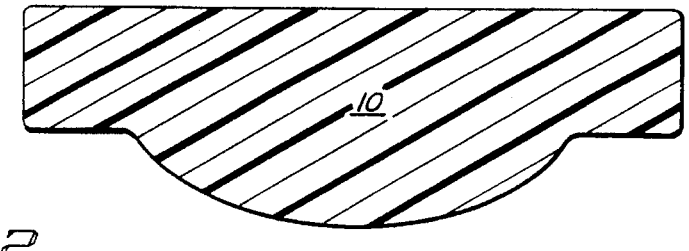
FIG. 7 is a cross-sectional view taken near the right end of the device along line 7—7 of FIG. 3.
Figure 2A:
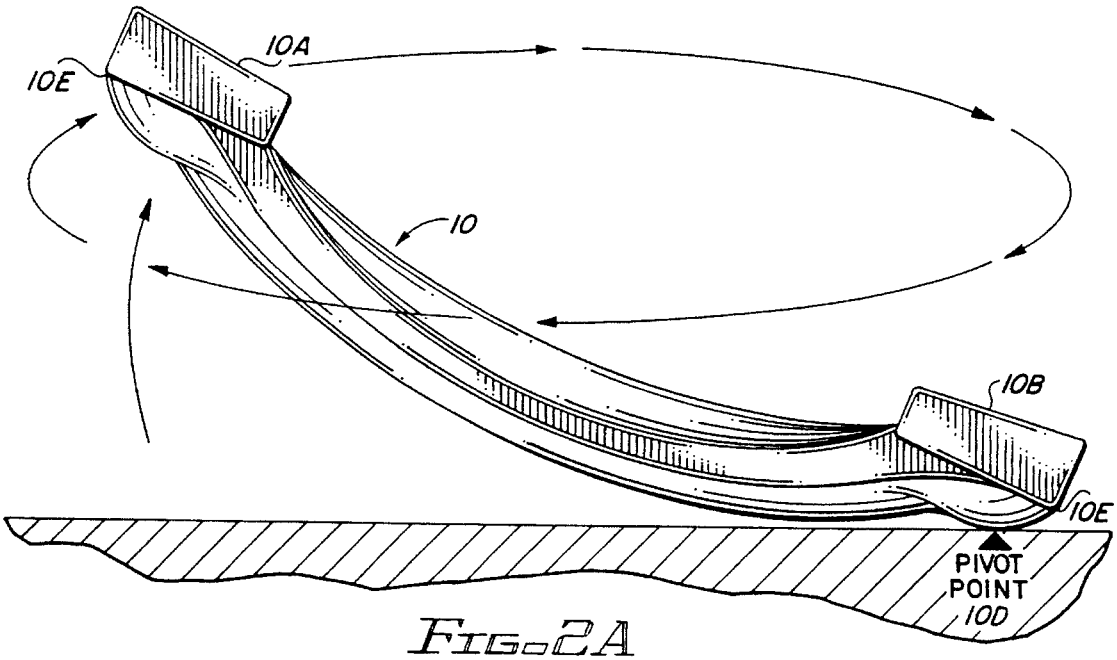
FIG. 2A is a detailed view of the position of the device when the exerciser is moving as shown in FIG. 2.

FIGS. 1 and 2 and 2A illustrate the various exercises and body movements possible with my exercise device 10 as shown in these figures. In FIG. 1 the exerciser is shown with his feet resting on the two spaced apart foot platforms and the midpoint of device 10 resting on the floor of the gymnasium. Due to the device's unique convex curvature in both its elongated length and its width, the exerciser can tilt forward and backward by leaning forward and then backward or rock from side to side by shifting his weight from one foot to the other.

In FIGS. 2 and 2A exerciser E is again shown with his feet resting on the two spaced apart foot platforms 10A and 10B and with smoothly rounded pivot point 10D resting on the floor. In this position exerciser E can spin himself around and around and by appropriate body and leg movement "roll" pivot point 10D along the gymnasium floor while still twirling around and around on pivot point 10D.

The exerciser begins by placing one foot on one platform and then placing the other foot on the other platform. As a beginner, the exerciser may wish to have in his hands a wand or pole to help stabilize his balance. Then by shifting his weight, the device which I have named the Roc-A-Way™ will move into action. Its movements will depend upon the exerciser—rock from side to side, lean forward and backward, spin or twist to the right or to the left, move across the floor while spinning on either the right or left pivot point until the exerciser causes both the pivot point, a point on the bottom of the device and an adjacent brake point 10E to touch the floor to stop further movement of exercise device 10 so that the exerciser can step down off the device.

The Roc-A-Way™ will operate on any solid surface such as wooden flooring, ceramic tile, concrete, vinyl and even carpeting. However, the harder and smoother the surface, the more active the Roc-A-Way™ will perform. For best results exercise device 10 made of a solid homogeneous material such as a high strength plastic material such as styrene or a hardwood such as maple or oak.

As shown in FIGS. 3, 4, 6, 7 and 8, the downwardly facing lower surfaces of device 10 are smoothly and convexly curved both with respect to its length and its width and this contributes to the ability of the device to quickly respond to the directions transmitted to it from the soles of the exerciser's shoes.

Figure 4:
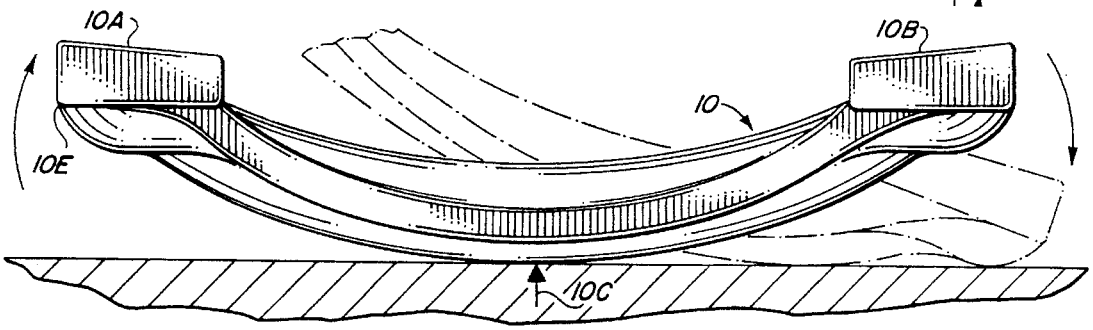
FIG. 4 is a front elevational view of the excise device resting on its midpoint 10C showing in phantom the device moving downwardly until the device rests upon its right pivot point.
Figure 5:
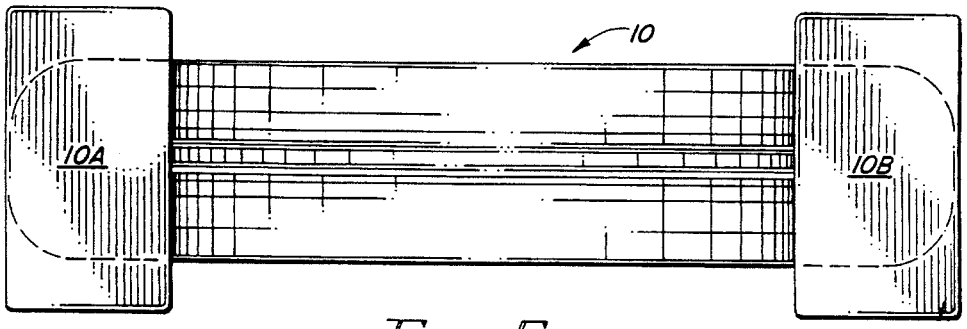
FIG. 5 is a plan view of the exercise device taken from above.

Roc-A-Way™ preferably has an overall length of 29 inches the foot platforms 10A and 10B are preferably 10 inches in length and five inches wide and the platforms are slanted slightly inward rather than being exactly horizontal as best shown in FIGS. 2A and 4. For best results, the exerciser should wear a pair of good athletic shoes. In order to prevent the exerciser's feet from slipping during operation of the Roc-A-Way™, platforms 10A and 10B may include a series of raised ridges or buttons or be covered with a thin film of slightly tacky plastic material.

Having illustrated and described a preferred embodiment of my Roc-A-Way™ exercise device, various changes and modifications of the invention will be apparent to those skilled in the art without departing from the spirit and scope of the invention. No limitation should be inferred from the foregoing descriptions. The scope of the invention is defined only by the appended claims.

I claim:

1. A balancing exercise device consisting essentially of:

elongated member symmetrical in cross section having first and second ends and a bottom surface, a pair of generally horizontal upwardly facing foot platforms sized to accommodate a user's feet, positioned one each on each of said ends of said elongated member, a single pivot point positioned on said bottom surface of said elongated member near each of its ends below said foot platforms and;

wherein said bottom surface is arcuately configured longitudinally and transversely and at said pair of pivot points substantially as shown in FIGS. 4, 18 and 2 and 2*a*, respectively.

2. A personal exercise device as set forth in claim 1 in which the device is made from a high strength plastic material such as styrene.

3. A personal exercise device as set forth in claim 1 in which the device is made from a hardwood such as maple.

4. A personal exercise device as set forth in claim 1 in which the device has an overall length of 29 inches and the two upwardly facing foot platforms are 10 inches long and 5 inches wide.

5. A personal exercise device as set forth in claim 1 which includes at each end of the device a spaced apart pair of brake points located directly beneath the two outer corners of the foot platform.

6. A personal exercise device as set forth in claim 1 in which both of the upwardly facing foot platforms are covered with a thin layer of tacky plastic material.

* * * * *